US005383977A

United States Patent [19]

Pearce

[11] Patent Number: 5,383,977

[45] Date of Patent: Jan. 24, 1995

[54] WORKBENCH AND WORKTABLE

[75] Inventor: Phillip W. Pearce, Washington, England

[73] Assignee: Black & Decker Inc., Newark, Del.

[21] Appl. No.: 236,231

[22] Filed: Apr. 8, 1994

Related U.S. Application Data

[63] Continuation of Ser. No. 130,328, Oct. 1, 1993, which is a continuation of Ser. No. 20,182, Feb. 16, 1993, abandoned, which is a continuation of Ser. No. 939,860, Sep. 2, 1992, abandoned, which is a continuation of Ser. No. 809,813, Dec. 18, 1991, abandoned.

[30] Foreign Application Priority Data

Mar. 11, 1990 [GB] United Kingdom ..... 9105059
Dec. 21, 1990 [GB] United Kingdom ..... 9027775

[51] Int. Cl.[6] ..... B25H 1/00

[52] U.S. Cl. ..... 144/286 A; 144/1 R; 144/285; 269/139; 269/901

[58] Field of Search ..... 269/16, 139, 901; 144/1 R, 285, 286 R, 286 A

[56] References Cited

U.S. PATENT DOCUMENTS

| | | | |
|---|---|---|---|
| 2,786,500 | 3/1957 | Unterfranz | 144/285 |
| 2,799,306 | 7/1957 | Martin | 144/285 |
| 2,990,859 | 7/1961 | Ruben | 144/285 |
| 4,154,435 | 5/1979 | Alessio | 269/901 |
| 4,155,609 | 5/1979 | Skafte et al. | 269/901 |
| 4,256,294 | 3/1981 | Hickman et al. | 144/285 |
| 4,281,570 | 8/1981 | Hill . | |
| 4,483,573 | 11/1984 | Keller | 144/286 R |
| 4,733,704 | 3/1988 | Wolff . | |
| 4,875,513 | 10/1989 | Skarsten | 144/286 R |
| 5,067,535 | 11/1991 | Wolff | 144/286 R |

FOREIGN PATENT DOCUMENTS

| | | |
|---|---|---|
| 0148617 | 7/1985 | European Pat. Off. . |
| 0222477 | 5/1987 | European Pat. Off. . |
| 2326272 | 4/1977 | France . |
| 8706341 | 5/1987 | Germany . |
| 0391115 | 3/1990 | Germany . |
| 2208071 | 2/1989 | United Kingdom . |
| 8402102 | 6/1984 | WIPO . |
| 8800514 | 1/1988 | WIPO . |

OTHER PUBLICATIONS

Partial European Search Report Mar. 27, 1992.

*Primary Examiner*—W. Donald Bray
*Attorney, Agent, or Firm*—Charles E. Yocum; Dennis A. Dearing; John D. Del Ponti

[57] ABSTRACT

A workbench comprises a work surface (2, 4) disposed on a supporting structure (3). The work surface comprises a vice jaw member (4) carrying a first vice jaw and a worktable (2) having a second complimentary vice jaw (51*a*). The worktable, in a working position thereof, lies in the same plane as the jaw member, and the jaws face one another and are adapted to be moved towards and away from one another by vice operating means (9). The worktable is pivotally mounted with respect to the supporting structure about an axis lying adjacent the back edge (51*b*) of the worktable, thereby enabling the worktable to be pivoted away from the supporting structure to give access to the underside of the worktable. The underside is provided with means (80) for mounting at least one power tool thereon, and has several tool apertures (70, 72, 74) through which working parts of the power tools can project to the upper side of the worktable for working on a workpiece presented to it when the worktable is returned to the working position. The vice operating means enables asymmetric separation between the vice jaws.

25 Claims, 4 Drawing Sheets

91
86
82
88
53
51d
54
5
55
57
63
74
53
51a
80
2
V
V
99
6
5
71
72
70'
76
99
72'
51b
70
80
80'
84
80
5
99
92
94
80
96
98
6
55
54
63
57
6
5
51c
53
5

71
2
104
70'
70
100
102
99
106
99'
105
108
110
80
80'
112

WORKBENCH AND WORKTABLE

This application is a continuation of application Ser. No. 08/130,328, filed Oct. 1, 1993, which is a continuation of application Ser. No. 08/020,182 filed Feb. 16, 1993, abandoned, which is a continuation of application Ser. No. 07/939,860 filed Sep. 21, 1992, abandoned, which is a continuation of application Ser. No. 07/809,813 filed Dec. 18, 1991 abandoned.

BACKGROUND OF THE INVENTION

This invention relates to workbenches, and worktables therefor, and particularly to workbenches of the type comprising a supporting structure and a work surface disposed on the structure and including vice means.

Such workbenches are well known and described, for example, in EP-0222477. In WO-8800514 there is disclosed a workbench of this type having a cut-out in one jaw of the vice means in which a cover plate may be disposed for ordinary vice and work surface usage, but which can be replaced by an insert plate adapted to carry various power tools. One such tool is a circular saw and in which event the workbench is transformed into a saw table. Different insert plates are used for mounting different power tools, but a statement is made (but not shown) that alternatively, one insert plate may be provided which is suitable for use with a range of different power tools.

SUMMARY OF THE INVENTION

It is an object of the present invention to provide a workbench, and a worktable for a workbench, which can perform the functions of vice and work surface as described in EP-0222477 but which also serves as a worktable for various power tools, and without any loss of performance of the vice function.

In accordance with the present invention there is provided a workbench comprising a work surface disposed on a supporting structure, the work surface comprising a vice jaw member carrying a first vice jaw and a worktable having a second complimentary vice jaw, the worktable in a working position thereof lying substantially in the same plane as the jaw member, with said jaws facing one another and being adapted to be moved towards and away from one another in said plane by vice operating means, and the worktable being pivotally mounted with respect to said supporting structure so as to enable said worktable to be pivoted away from the supporting structure to give access to the underside of the worktable which is provided with means for mounting at least one power tool thereon, the worktable having a tool aperture through which a working part of said at least one power tool is adapted to project to the upper side of the worktable for working on a workpiece presented to it when the worktable is returned to said working position.

Preferably said worktable is pivotable about an axis lying parallel to the vice jaws of the worktable and spaced therefrom.

Preferably said vice jaw member is fixed with respect to the supporting structure and said worktable is movable by said vice operating means.

Preferably said vice operating means enables asymmetric separation between the vice jaws in said plane.

Preferably said worktable has at least two hinge means fixed thereto for pivotal connection to said support structure; which preferably comprises a collapsible frame including two spaced parallel inverted channel sections, each incorporating separate vice operating means, said vice jaw member being fixed to one end of each channel section and said hinge means being fixed to support blocks supported on said channel sections and connected to said vice operating means through a longitudinal slot in each channel section.

Preferably locking means is provided to lock the worktable in said working positon. Said hinge means may be provided with a degree of freedom of movement to allow the worktable to move away from said vice jaw member in the plane of said working position from a first to a second disposition thereof, and in which case said locking means may comprise hook means on one of said worktable and support structure adapted, in the first of said dispositions, to engage the other of said support structure and worktable respectively to lock the worktable in said working position, and to disengage the worktable from said support structure in the second of said dispositions to allow the worktable to be pivotted away from said support structure.

Preferably said hinge means comprises first and second hinge parts, the first parts being of channel section and fixed to the underside of said worktable and the second part being pivotted to the first part and being secured to said support structure. Said degree of freedom is preferably provided by a pivot pin secured between said hinge parts passing through and being slidable in a slot in said first part, the slot being oriented in a direction parallel to the plane of the worktable.

Said hook means may comprise a backwardly directed ledge on the underside of the worktable behind its complimentary vice jaw, the ledge being adapted to engage the front of said second hinge part.

The invention also provides a worktable for use on a workbench, said worktable comprising a vice jaw, for cooperation with a complimentary vice jaw on said workbench, and at least two hinge means having a pivot axis parallel with and spaced from said vice jaw, the worktable having means for mounting at least one power tool on an underside thereof, and a tool aperture through which a working part of said power tool is adapted to project for operation on a workpiece on an upper side of said worktable, said worktable being adapted to be secured to said workbench by means of said hinge means.

BRIEF DESCRIPTION OF THE DRAWINGS.

The invention is further described hereinafter, by way of example only, with reference to the accompanying drawings, in which.

Figure 1:
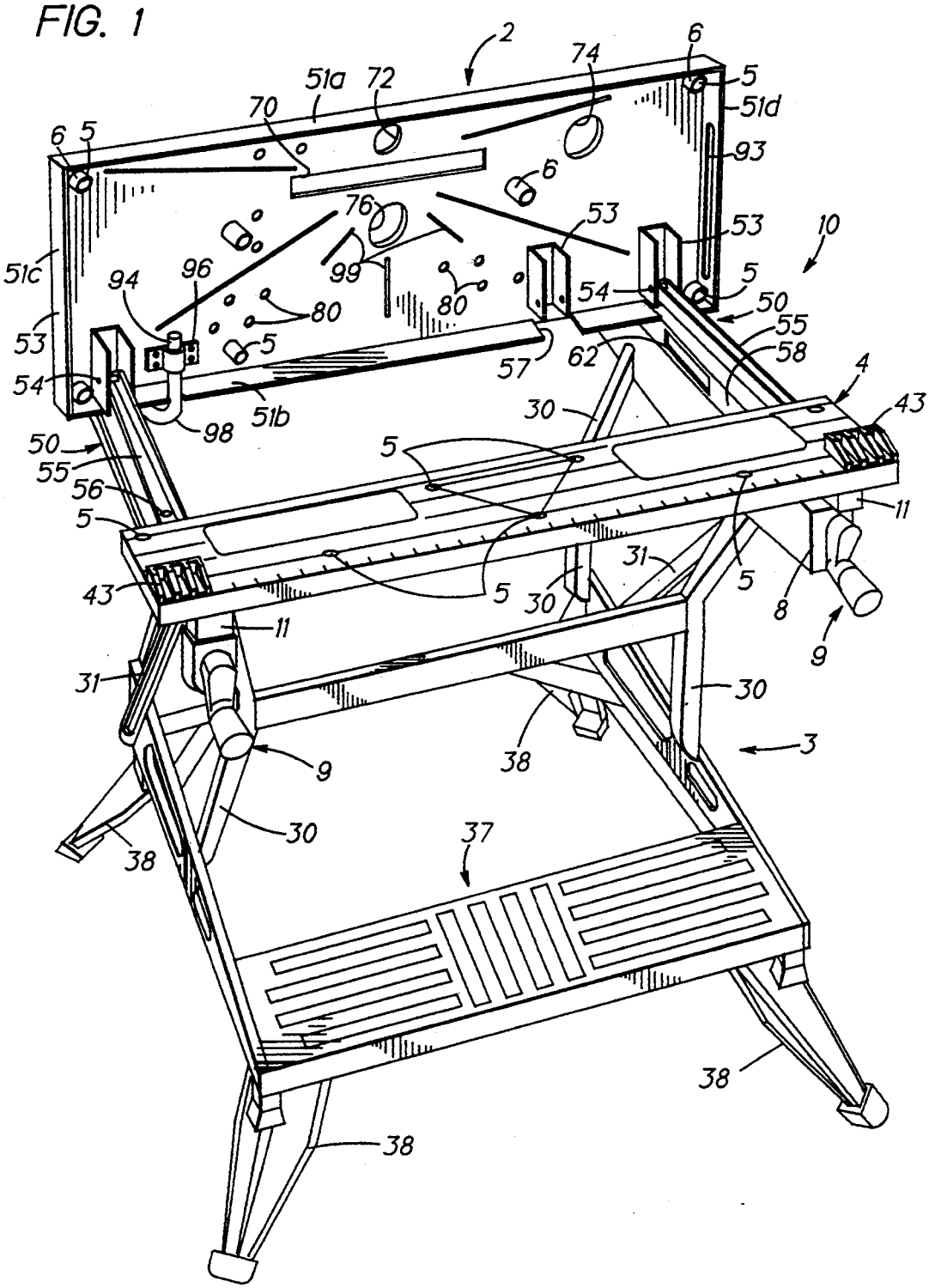
FIG. 1 is a front perspective view of a workbench according to the present invention.

DETAILED DESCRIPTION OF THE PREFERRED EMBODIMENTS.

In the drawings, a workbench 10 according to the present invention comprises a support structure 3 having a work surface mounted thereon. The work surface consists of a worktable 2 and a vice jaw member 4. The vice jaw member 4 is securely fixed on two inverted channel section beams 8, through support blocks 11. The vice jaw member 4 is made of ply wood and has a number of holes 5 for receiving page 43, which serve as abutment means for the vice function of the workbench 10 as explained further below.

The support structure 3 comprises two parallel I-shaped elements 30, pivotally connected to the beams 8 and a base 37 in parallelogram formation. A diagonal member 31 braces the structure and holds it in the position shown. A latch mechanism (not shown) releases the diagonal member 31 and enables the structure to be folded flat. Legs 38 depend from each corner of the base 37, and can be folded flush with the base for storage or to reduce the working height of the workbench 10.

The vice jaw member 4 and structure 3, including the beams 8, are well known and described in EP-0222477 and need no further description here. Indeed, it is one of the features of the present invention that a worktable according to the invention can be employed on existing workbenches having such a construction as shown and described in the aforementioned European patent.

The worktable 2 comprises a substantially flat sheet of steel formed as a tray with downwardly depending lips 51*a–d*. To the underside of the worktable 2 are fixed three channel sections forming first hinge parts 53, near the rear edge 51*b* of the worktable. In two of these parts are pivotally supported about hinge axis 54 second hinge parts 55, which, together with the first hinge parts 53 constitute hinge elements 50. The second hinge parts 55 are secured by bolts 56 (see FIGS. 2 and 3) through support blocks 58 to vice sockets 60 which protrude through slot 62 formed in the top of inverted channel beam 8. The vice socket 60 is threaded on vice screw 64. The vice screw 64 is rotatable by handle 9 (FIG. 1) causing vice socket 60 and support block 58 to slide along beam 8.

Figure 2:
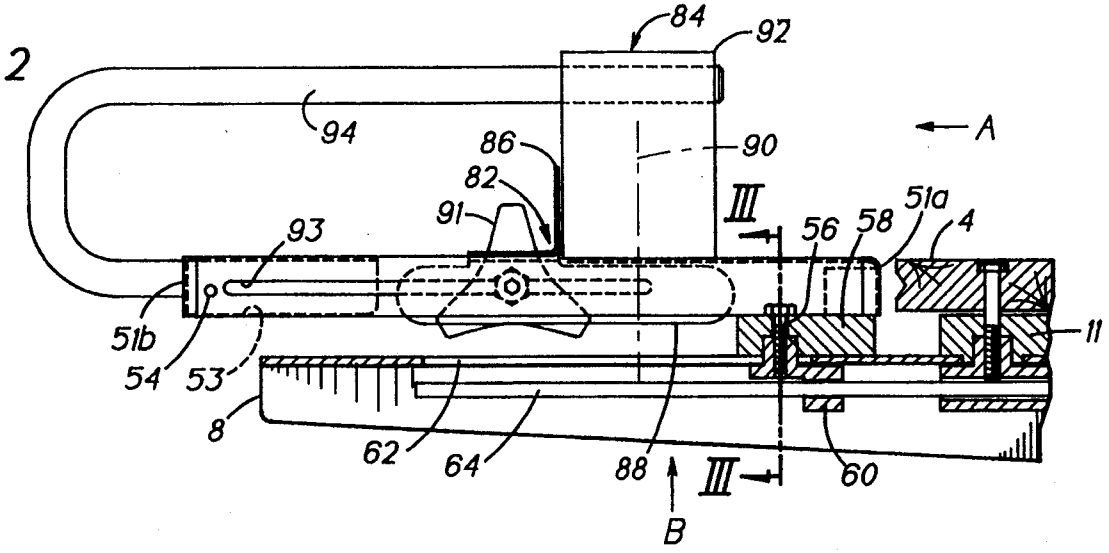
FIG. 2 is a left side elevational view, (partly in section along the line II—II in FIG. 3), of the workbench in FIG. 1.
Figure 3:
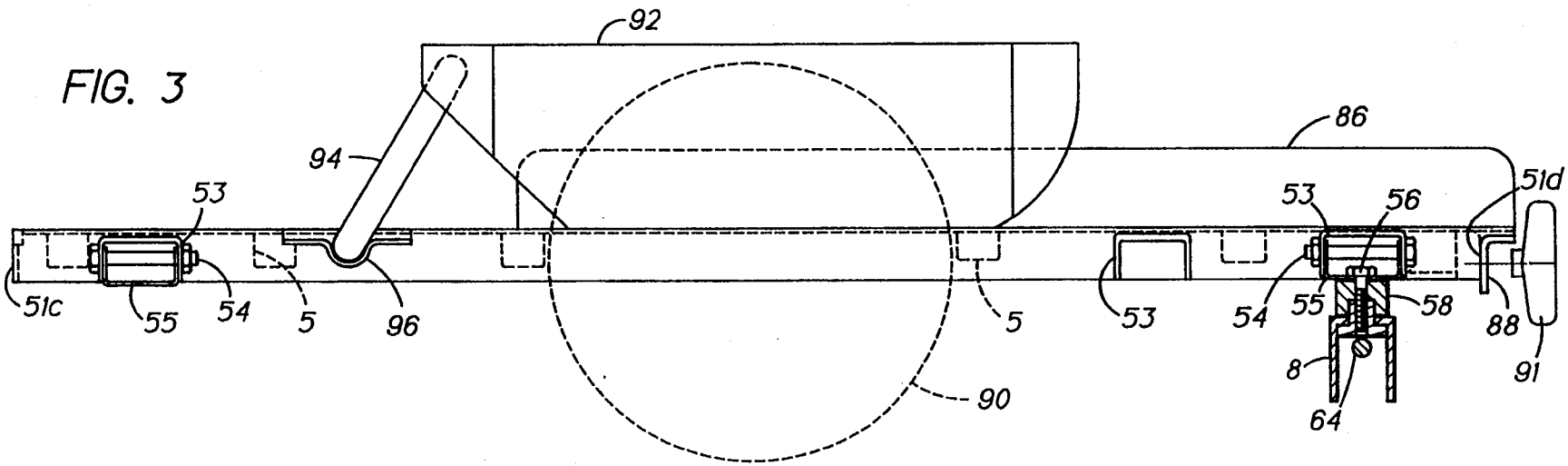
FIG. 3 is a front elevational view in the direction of the arrow A in FIG. 2, and also partly in section along the line III—III in FIG. 2.

When the worktable 2 is pivoted down from the position shown in FIG. 1 to a working position as shown in FIGS. 2 and 3, its front edge 51*a* forms a vice jaw lying in the same plane as fixed vice jaw 4. Operation of the handles 9 moves the jaws towards and away from one another in parallel or asymmetrically, as fits the article which is to be gripped between them.

The first hinge parts 53 are a channel section so that they provide lateral support for the first hinge parts 55 when the vice is operated, particularly when asymmetric gripping between the vice jaws is required.

When an article is clamped between the vice jaws 4, 51*a* the strain on the worktable 2 and hinges 50 is kept to a minimum by the back of the front edge 51*a* abutting the front 63 of the hinge parts 55 (see FIG. 4), so that the forces generated by vice closure are absorbed directly by the support block 58 and vice socket 60.

However, the reason why the hinge parts 55 are long is so as to position the hinge axis 54 of the hinge elements 50 adjacent or near to the rear edge 51*b* of the worktable 2. This enables the worktable to be pivoted upwardly and away from the fixed vice jaw 4 (once the tension on the vice screws 64 has been released) to give access to the underside of the worktable 2.

Indeed the edge 51*b* is provided with cut-outs 57 opposite each hinge part 53 so that the worktable 2 can be pivoted over backwards to a substantially horizontal inverted position. In this respect, the hinge axis 54 is as far removed from the edge 51*b* as the vertical clearance from the beam 8 allows. This has the effect of minimising the potentially damaging leverage that the hinge parts 55 could exert on the edge 51*b* when the worktable is pivoted that far backwards.

The worktable 2 has various tool apertures such as those shown at 70, 74 and 76, each serving to receive the working part of a different power tool. Thus aperture 70 is a long slot adapted to receive the blade of a circular saw. Numerous other holes 80 are provided around the worktable 2 to enable a power tool to be secured to the underside of the worktable.

Referring now to FIGS. 2 and 3, the worktable 2 includes, particularly for when a circular saw is employed, a rip fence 82 and saw guard 84. The rip fence 82 includes two L-sections 86, 88 fixed together in a T. The long section 86 forms the guide while the section 88 is securable to the edge 51*d* of the worktable 2 by a screw 91 passing through a slot 93 (see FIGS. 1, 3 and 4,) in the edge 51*d*. Thus the position of the fence guide 86 is adjustable for cuts of different widths of material fed to saw blade 90.

The saw guard 84 consists of a box 92 and a pivotable support 94 retained by clip 96 disposed on the underside of the worktable 2 adjacent its rear edge 51*b*. The rear edge 51*b* has a cut-out 98 through which the guard support 94 passes.

Figure 4:
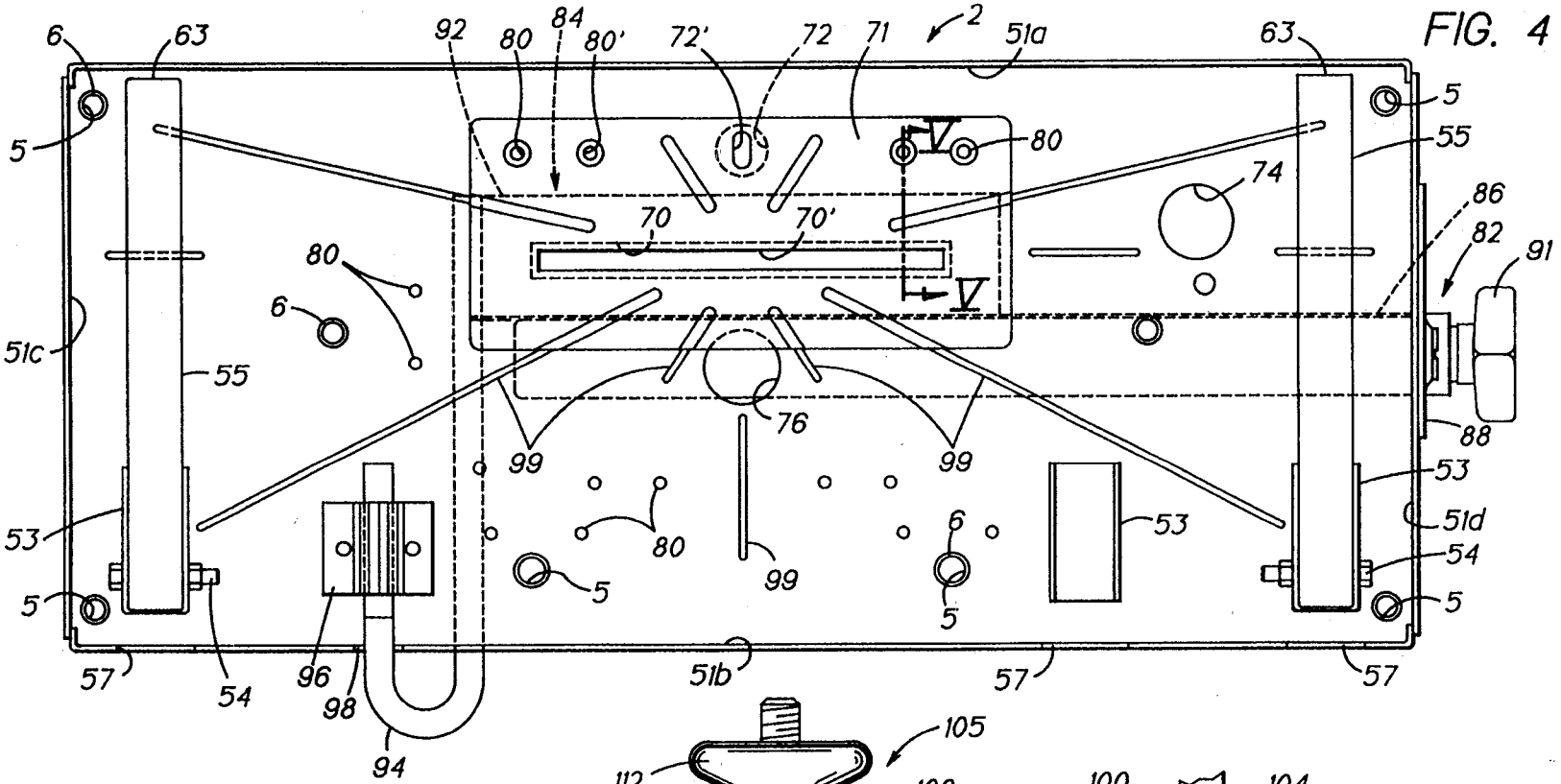
FIG. 4 is a bottom plan view in the direction of the arrow B in FIG. 2.

With referenct to FIGS. 1 and 4, hole 72 is adapted for a jig saw, hole 76 for a router (neither shown), while hole 74 is to receive the chuck of a drill (also not shown). The tools are secured in a working position in the worktable by various means as may be convenient. For example, collars are available for the attachment of drills to various apparatus and the same means can be employed here. Clips, as described further below, may be provided, and these enable a wide variety of different makes of tools, which, in the case of circular saws and jigsaws, invariably have a shoe plate by means of which they may be secured to the worktable.

In any event, however, one of the features of the present invention is that the tools which it might be desired to employ in the worktable 2 can be fitted with the worktable in a horizontal inverted position. This considerably facilitates attachment of the power tool to the worktable. Subsequently the worktable can be pivoted down to the position shown in FIGS. 2 and 3 once the tools are secured in place and are to be employed.

The weight of the tools (and the material being worked on) will normally be adequate to hold the worktable in its working position, but added security can be achieved simply by tightening the vice jaws 51*a*, 4 against each other. This tensions and tightens the hinge elements 50, as well as clamping the edge 51*a* of the worktable between hinge part 55 (63) and the vice jaw 4.

Nevertheless, even while a tool is in place in the worktable 2, the vice function of the workbench 10 is still operational.

The third hinge part 53 is provided so that the worktable 2 can be used on workbenches of a different configuration to that shown in FIG. 1, that is to say, on workbenches having beams 8 with a smaller separation between them that that of FIG. 1. Also it should be noted that the worktable 2 is provided with holes 5 at various locations adapted to receive further pegs 43 enabling objects to be clamped on the workbench 10 which are wider than the maximum separation between the vice jaws 51*a*, 4.

The holes 5 are supported by sleeves 6 which prevent pegs inserted into them from twisting out of alignment when force is applied to them by an article gripped between those pegs and opposing pegs 43 in the vice member 4.

The worktable tray may be stiffened by indentations such as those shown at 99. Also, the various holes 80 will be counter-sunk by indentation of the tray 2 so that the heads of bolts employed to hold tools supported underneath the worktable 2 will not stand pround of its surface.

Figure 5:
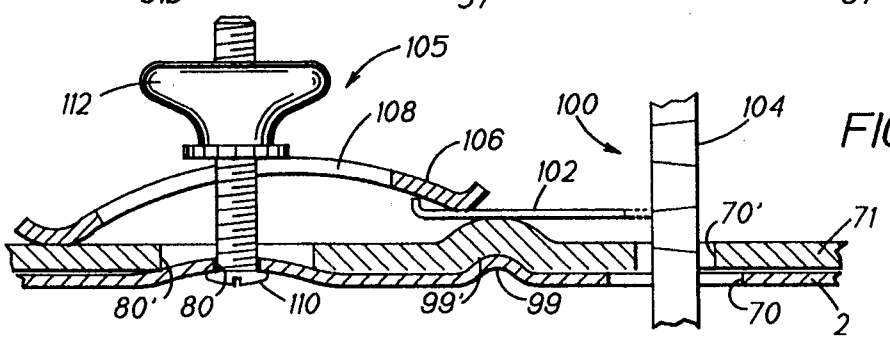
FIG. 5 is a part section on the line V—V in FIG. 4.

It will be appreciated that when a power tool is to be mounted in a steel worktable such as that described herein, and where the means of mounting the tool is as arbitrary and flexible as discussed further below, then it is very desirable that means are provided to ensure as far as possible that the working parts of the tool do not contact the worktable. To this end, the apertures 70, 72, 74 and 76 are all large to give plenty of clearance. Moreover there is provided an aluminium plate 71 FIGS. 4 and 5) for use with a circular saw or a jig saw. This plate has corresponding apertures 70', 72' which are smaller than those of the worktable 2. The plate 71 is located against the worktable 2 by holes 80' and indentations 99' corresponding in size and position with those in the worktable 2. When a tool (in this case either a jigsaw or circular saw) is to be attached to the worktable, the plate 71 is first located on the indentations 99 and countersunk holes 80. The tool (for example circular saw 100, FIG. 5) is then placed on top with its blade 104 protruding through the relevant aperture 70, 70'.

The saw 100 has a shoe 102' which rests on the tops of the indentations 99' and is held in that position by clips 105 which simply comprise an arcuate member 106 with a central slot 108 for a screw 110 which is seated in an adjacent hole 80 in the worktable 2 and secured by a thumb-screw 112. The clip 106 deforms slightly on tightening of thumb-screw 112 to grip firmly the shoe plate 102. At least two and preferably at least three of such clips 106 are employed to secure the tool 100 in place. A similar arrangement is feasible with a jigsaw as regards aperture pair 72, 72'. However, with this arrangement it is of course quite feasible for a careless operator to position the tool with respect to the plate 71 so that the blade contacts the aperture 70' or 72' as the case may be. However, because the plate 71 is made of aluminium or a similar soft material, damage to the blade, and the danger of its shattering and possibly causing injury, is minimised. The possibility of inaccurate positioning of the plate 71 with respect to the worktable is small, given the matching positions of the holes 80, 80' and indentations 99, 99', which naturally tend to locate the plate 71 correctly on the worktable 2.

A similar arrangement may be provided for a router as regards aperture 76 in the worktable, although nothing further in that respect is required for the drill aperture 74. Here the whole chuck of the drill protrudes through the aperture 74 so there is no danger of rotating tool bits contacting the worktable.

In contra-distinction to the workbench 10 shown in the drawings, it is quite feasible to arrange for the fixed vice member 4 to be the vice member which is movable with respect to the supporting structure 3 by the vice operating means 9. In this event the slots 62 in the beams 8 may be replaced by a line of keyhole slots in each beam as shown in EP-0222477. The hinge parts 55 are then fixed to the support blocks 58 which are each provided with a downwardly projecting lug adapted to engage a keyhole slot in each beam. Which keyhole slot is selected depends on the gap required between the jaw members.

Figure 6:
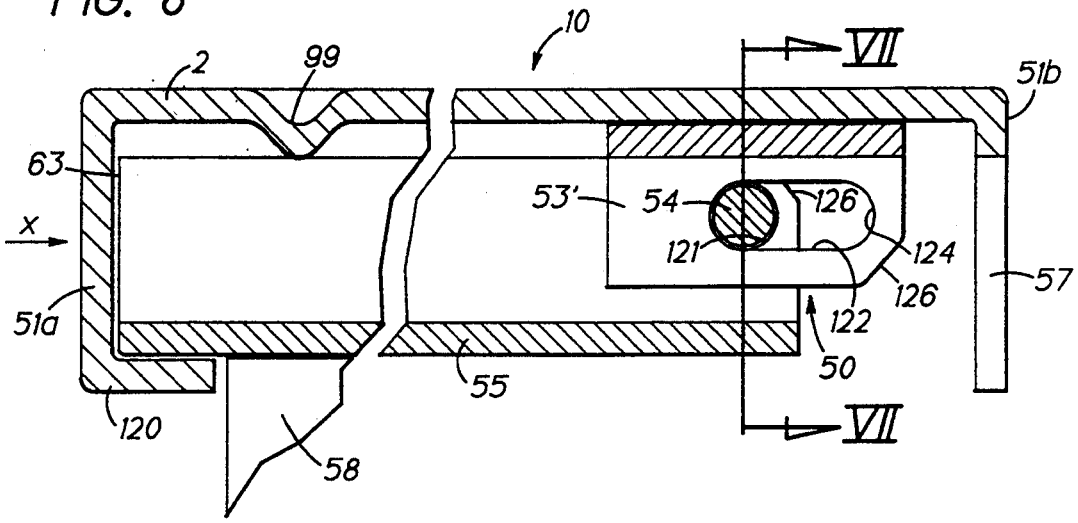
FIG. 6 is a partial section through a preferred embodiment of the present invention, along the line VI—VI in FIG. 7.
Figure 7:
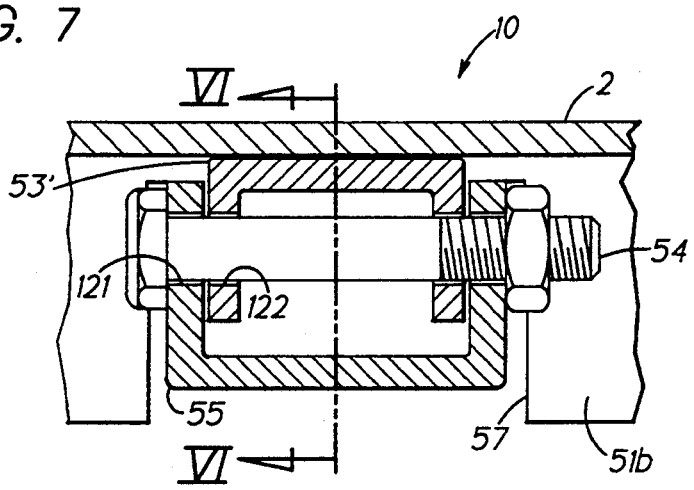
FIG. 7 is a section of the line VII—VII in FIG. 6.

FIGS. 6 and 7 illustrate a preferred embodiment of the present invention. Here, the hinge means 50 comprises first hinge part 53' secured to the underside of the worktable 2, for example by spot welding, and second hinge part 55, which is secured to said support block 58. A stud and bolt combination 54 secures the two hinge parts together and forms a pivot pin between them.

When pressure is applied in the direction of the arrow X in FIG. 1 by objects clamped between the vice jaws, some of the stress on face 51*a* is absorbed by the front edge 63 of the second hinge part 55. This also removes stress on the pivot pin 54.

However, the embodiment of FIG. 6 provides a backwardly turned ledge or hook means 120 on the bottom of face 51*a* of the worktable 2. This serves to hook under the front edge 63 of the second hinge part which here protrudes beyond the front edge of the support block 58. By this means the worktable 2 is prevented from pivotting upwardly which it might tend to do under certain stresses by the effect referred to as cam-out. Although this effect is already countered to some extend by the back of face 51*a* being pressed against front edge 63 of the hinge part 55, this on its own will not always prevent cam-out. However, the provision of said hook means 120 does serve this purpose.

In order to allow the worktable to pivot upwardly when this is wanted, for example to position or reposition tools on the under-side of the worktable, then it is necessary to allow the table 2 first to move in a direction opposite to arrow X. This is achieved by mounting the pivot pin 54 in a slot 122 in the first hinge part 53', and in circular hole 121 in the second hinge part 55.

Thus the whole worktable may be shifted leftwardly (in FIG. 6) to move the pin 54 to the right end 124 of slot 122. In this position the ledge 120 clears the second hinge part 55 and the worktable can pivot upwardly.

It will be apparent that, apart from the engagement of the hook means 120, the table cannot pivot upwardly in the position shown in FIG. 6 because the hinge parts 53', 55 would interfere with one another. As it is, they are provided with chamfered edges 126, but this would be insufficient to allow pivotting in the position of FIG. 6. It is for this reason that the slot 122 is in the first hinge part 53' and not in the second hinge part 55. If the latter was the case then movement of the worktable 2 to the left to release the hook means 120 would move the hinge means 50 to a position equivalent to that shown in FIG. 6, and so pivotting would be prevented. Because the slot 122 is in the first hinge part 53', that part is disposed inside the confines of the second hinge part 55 in this embodiment. This means that tightening of the pivot pin 54 will not affect sliding thereof in the slot 122.

On the other hand, if the hook means 120 was short, and if sufficient slack was provided in the hinge means 50, an arrangement where the slot 122 was in the second hinge element 55 could, in fact, be contemplated, although a certain amount of judicial persuasion may be required to manouvre the worktable from its locked working position to a freely pivotting position.

What is claimed is:

1. A workbench comprising a work surface disposed on a supporting structure, the work surface comprising a vice jaw member carrying a first vice jaw and a worktable having a second complimentary vice jaw, the worktable in a working position thereof lying substantially in the same plane as the jaw member, the said jaws facing one another and being adapted to be moved towards and away from one another in said plane by vice operating means, and the worktable being pivotally mounted with respect to said supporting structure so as to enable said worktable to be pivoted away from the supporting structure to give access to the underside of the worktable which is provided with means for mounting at least one power tool thereon, the worktable having a tool aperture through which a working part of said at least one power tool is adapted to project to the upper side of the worktable for working on a workpiece presented to it when the worktable is returned to said working position.

2. A workbench as claimed in claim 1 in which, said worktable is pivotable about an axis lying parallel to the vice jaw of the worktable and spaced therefrom.

3. A workbench as claimed in claim 2 in which said worktable has at least two hinge means fixed thereto for pivotal connection to said support structure, in which said support structure comprises a collapsible frame including two spaced parallel support beams, each incorporating separate vice operating means, said vice jaw member being fixed to one end of each beam and in which said worktable is substantially rectangular in plan and in which said pivot axis is parallel with a rear edge of said worktable and spaced therefrom by an amount less than the separation of the upper side of the worktable and said beam, thereby enabling said worktable to pivot from said working position to a substantially horizontal inverted position.

4. A workbench as claimed in claim 3 in which said hinge means is fixed to support blocks supported on said beams and connected to said vice operating means through a longitudinal slot in each beam.

5. A workbench as claimed in claim 3 in which each hinge means comprises first and second hinge parts, said first parts being fixed to the underside of said worktable and said second parts being pivoted to said first parts and being secured to said beams.

6. A workbench as claimed in claim 5 in which said worktable is a metal sheet with a downwardly depending edge forming said vice jaw.

7. A workbench as claimed in claim 5 in which one end of each of said second parts of each hinge means lies adjacent said downwardly depending edge when the worktable is in said work position such that said edge is gripped between said end and said first vice jaw when said vice operating means is operated.

8. A workbench as claimed in claim 6 in which said downwardly depending edge extends around the whole of said worktable and has cut-outs at the rear edge thereof opposite each of said hinge means.

9. A workbench as claimed in claim 8 in which a guide fence is provided comprising two L-sections secured as a T with the stem of the T forming said guide and the cross of the T being securable to said downwardly depending edge at one side of said worktable by a bolt passing through and slidable along a slot in said edge.

10. A workbench is claimed in claim 9 further comprising a plate having a tool aperture corresponding with but smaller than said tool aperture in the worktable.

11. A workbench as claimed in claim 10 in which indentations are formed in said worktable providing rigidity therefor and in which said plate is aluminium and has corresponding indentations to aid location of said plate with respect to the worktable.

12. A workbench as claimed in claim 11 in which said means for mounting said at least one power tool includes clip means comprising an arcuate member having a slot through which a screw is adapted to pass, having first been fitted through a hole in said worktable, nut means being adapted to fit said screw and, on tightening thereof, to clamp the ends of said arcuate member against the underside of said worktable, a part of a power tool being fitted under one of said ends.

13. A workbench as claimed in claim 12 in which each hole is countersunk sufficiently to ensure that the head of said screw does not stand proud of the surface of said worktable.

14. A workbench as claimed in claim 13 in which said plate has holes corresponding with each worktable hole which said plate covers, the countersinking of each said worktable hole further serving to correctly locate said plate with respect to the worktable.

15. A workbench as claimed in claim 14 further comprising locking means to lock the worktable in said working position.

16. A workbench as claimed in claim 3 in which said hinge means is provided with a degree of freedom of movement to allow the worktable to move away from said vice jaw member in the plane of said working position from a first to a second disposition thereof, and in which said locking means comprise hook means on one of said worktable and support structure adapted, in the first of said dispositions, to engage the other of said support structure and worktable respectively to lock the worktable in said working position, and to disengage the worktable from said support structure in the second of said dispositions to allow the worktable to be pivotted away from said support structure.

17. A workbench as claimed in claim 16 in which said degree of freedom is provided by a pivot pin secured between said hinge parts passing through and being slidable in a slot in said first part, the slot being oriented in a direction parallel to the plane of the worktable.

18. A workbench as claimed in claim 16 in which said hook means comprises a rearwardly directed ledge on said downwardly depending edge, the ledge being adapted to engage the front of said second hinge part.

19. A worktable for use on a workbench, said worktable comprising a vice jaw, for co-operation with a complimentary vice jaw on said workbench, and at least two hinge means having a pivot axis parallel with and spaced from said vice jaw, the worktable having means for mounting at least one power tool on an underside thereof, and a tool aperture through which a working part of said power tool is adapted to project for operation on a workpiece on an upper side of said worktable, said worktable being adapted to be secured to said workbench by means of said hinge means.

20. A workbench as claimed in claim 4 in which each hinge means comprises first and second hinge parts, said first parts being fixed to the underside of said worktable and said second parts being pivoted to said first parts and being secured to said beams.

21. A workbench as claimed in claim 20 in which said worktable is a metal sheet with a downwardly depending edge forming said vice jaw, and in which one end of each of said second parts of each hinge means lies adjacent said downwardly depending edge when the worktable is in said work position such that said edge is gripped between said end and said first vice jaw when said vice operating means is operated.

22. A workbench as claimed in claim 21 in which said downwardly depending edge extends around the whole of said worktable and has cut-outs at the rear edge thereof opposite each of said hinge means.

23. A workbench as claimed in claim 15 in which said hinge means is provided with a degree of freedom of movement to allow the worktable to move away from said vice jaw member in the plane of said working position from a first to a second disposition thereof, and in which said locking means comprise hook means on one of said worktable and support structure adapted, in the first of said dispositions, to engage the other of said support structure and worktable respectively to lock the worktable in said working position, and to disengage the worktable from said support structure in the second of said dispositions to allow the worktable to be pivotted away from said support structure.

24. A workbench as claimed in claim 23 in which said degree of freedom is provided by a pivot pin secured between said hinge parts passing through and being slidable in a slot in said first part, the slot being oriented in a direction parallel to the plane of the worktable.

25. A workbench as claimed in claim 24 in which said hook means comprises a rearwardly directed ledge on said downwardly depending edge, the ledge being adapted to engage the front of said second hinge part.

* * * * *